US006386677B1

(12) United States Patent
Imai et al.

(10) Patent No.: US 6,386,677 B1
(45) **Date of Patent: *May 14, 2002**

(54) INK JET RECORDER, RECORDING METHOD AND PURGING METHOD

(75) Inventors: Koji Imai; Hirotake Nakamura, both of Nagoya (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/053,680

(22) Filed: Apr. 2, 1998

(30) Foreign Application Priority Data

| | | |
|---|---|---|
| Apr. 3, 1997 | (JP) | 9-085365 |
| Jul. 8, 1997 | (JP) | 9-182744 |
| Feb. 13, 1998 | (JP) | 10-031503 |

(51) Int. Cl.[7] ..... B41J 2/165

(52) U.S. Cl. ..... 347/23

(58) Field of Search ..... 347/23, 32, 33, 347/29

(56) References Cited

U.S. PATENT DOCUMENTS

| | | | | | |
|---|---|---|---|---|---|
| 4,695,852 | A | * | 9/1987 | Scardovi | 347/14 |
| 5,847,726 | A | * | 12/1998 | Hori | 347/23 |
| 6,042,214 | A | * | 3/2000 | Minowa et al. | 347/23 |
| 6,042,218 | A | * | 3/2000 | Nakahara | 347/35 |

FOREIGN PATENT DOCUMENTS

| | | |
|---|---|---|
| EP | B-604 938 | 7/1994 |
| JP | 8-2520028 | 10/1996 |

* cited by examiner

*Primary Examiner*—N Le
*Assistant Examiner*—Shih-wen Hsieh
(74) *Attorney, Agent, or Firm*—Oliff & Berridge, PLC

(57) ABSTRACT

An ink jet recorder includes a recording head having an ejection nozzle, and a purging apparatus for recovering the ejecting condition of the nozzle. The recorder further includes a timer for clocking the time having passed after the last purging by the purging apparatus, and a controller for controlling the head and the purging apparatus. If a command for operating the head is input in the recorder, and on condition the time clocked by the timer exceeds a predetermined time period, the controller starts the head ejecting ink. The air bubbles produced in the head by purging can vanish naturally during the predetermined period. It is therefore possible to improve the ejecting characteristic and secure high recording quality.

24 Claims, 14 Drawing Sheets

INK JET RECORDER, RECORDING METHOD AND PURGING METHOD

BACKGROUND OF THE INVENTION

1. Field of the Invention

The present invention relates to an ink jet recorder, such as an ink jet printer having a purging apparatus for sucking ink from a ink jet head, and a purging method and recording method for the ink jet printer.

2. Description of Related Art

Ink jet printers are known generally as ink jet recorders for recording on recording media, such as sheets of paper, by ejecting ink onto them.

FIG. 13 of the accompanying drawings shows part of a conventional ink jet printer, which includes a recording head unit P3 having a recording head P2. The head P2 has four ejection nozzles P4, each of which has ejection holes (not shown) opening in its front surface P5. Four ink cartridges P1 containing link are mounted replaceably on the head unit P3, and each connected to one of the nozzles P4. After each cartridge P1 is replaced with a new one, ink is supplied from the new cartridge to the head P2, and can be ejected from the associated nozzle P4.

While the printer is used, ink may be sucked from the nozzle surfaces P5 to purge the nozzles. The purging may be started manually by the user operating a switch on the printer, or automatically if a predetermined condition is satisfied.

The purging is performed to prevent the defective ejection of ink which may be caused if the ink in or on the recording head P2 dries, or if air bubbles are produced in the ink, or if droplets of ink stick to the nozzle surfaces P5. Specifically, the purging of each nozzle P4 involves covering its nozzle surface P5 with a suction cap P6, and then developing negative pressure in the cap P6 by means of a suction pump (not shown), in order to suck ink from the head P2 through the cap P6 and discharge the sucked ink outside.

It is not avoidable that, when each cartridge P1 is replaced with a new one, air enters the flow passage between the new cartridge P1 and the recording head P2. Therefore, after the new cartridge P1 is substituted, the purging is repeated consecutively as initial purging to remove the air from the passage and introduce new ink into the head P2.

If a recording command is input in the printer, the ejecting function of the printer is recovered by purging depending on the period (days) of nonuse of the printer, and immediately thereafter the printer starts printing. Just after the purging, very small air bubbles may be produced in the ink in the recording head P2. For example, air bubbles may be produced by the rapid flow of ink due to the purging. On the other hand, the purging may cause ink to bubble in the suction cap P6. In this case, when the cap P6 is separated from the nozzle surface P5 of the purged nozzle P4, the bubbly ink in the cap is forced into the nozzle by the negative pressure acting from the inner side of the nozzle. If air bubbles thus remain in the ink passages, the bubbles may absorb part of the ejection pressure and block part of the passages when ink is ejected. This impedes or hinders the ejection, and lowers the recording quality.

If quite a long time has passed after the last recording, two or more cycles of purging may be performed to improve the ejection of ink. In particular, the purging is repeated consecutively a plurality of times as the initial purging for introducing new ink into the recording head P2 after each cartridge P1 is replaced. After such a series of purges, air bubbles may remain in the purged nozzle P4 or the associated ink flow passage in the head P2. The ink flow velocity is lower toward the wall of the passage, and it is therefore difficult to remove the bubbles near the wall. Consequently, even if the purging causes ink to flow, air bubbles are liable to collect near the passage wall. Because the purging is repeated consecutively, the bubbles near the passage wall grow larger. This is considerable in particular at the corners of the passage, lowering the recording quality.

SUMMARY OF THE INVENTION

It is an object of the invention to provide an ink jet recorder which can perform good recording without its ejecting characteristic worsening even after purging.

It is another object of the invention to provide an ink jet recorder including a recording head having a plurality of ejection nozzles which can be purged individually, the recorder being able to cause the air bubbles produced in the head by purging to vanish effectively, and able to shorten the standby time.

It is still another object of the invention to provide a recording method for enabling the air bubbles produced in the recording head of an ink jet recorder by purging to vanish effectively.

It is a further object of the invention to provide a purging method which enables the air bubbles produced in the recording head of an ink jet recorder by purging to vanish effectively, and which can shorten the standby time. The head has a plurality of ejection nozzles which can be purged individually.

In accordance with a first aspect of the invention, an ink jet recorder is provided. The recorder includes a recording head having an ejection nozzle for ejecting ink onto a recording medium. The recorder also includes a purging apparatus for purging the nozzle to improve the ejection of ink from the nozzle. The recorder further includes a judging device and an authorizing device. If a command for operating the head is input in the recorder, the judging device judges whether a first time period has passed or not after the last purging by the purging apparatus. If the judging device judges that the first period has passed, the authorizing device authorizes the operation of the head. Thereby, the recorder performs recording, not just after the nozzle is purged, but when the first time period has passed after the purging. This period is sufficient for most of the air bubbles produced by the purging to vanish naturally. This eliminates air bubbles from the ink in the recording head, improving the ejecting characteristic. It is therefore possible to secure high recording quality.

The ink jet recorder may further include a purge controller for controlling the purging apparatus. The controller may make the purging apparatus perform purging before the recording head starts the recording authorized by the authorizing device. If the passage of time after the first time period is considerably short, the controller may control the purging apparatus in such a manner that no purging is performed. If the passage of time after this period is considerably long, recording may be started after purging is performed as the need arises. Thereby, the head is restored from the dryness of ink caused after the last purging and/or the production of air bubbles also caused after the last purging in the ink in the head. If this purging is performed, it is possible to cause the bubbles produced by the purging to vanish, by controlling the purging apparatus in such a manner that this apparatus waits a predetermined time after the purging and before the head starts recording.

The recording head may have a plurality of ejection nozzles in place of the single nozzle. In this case, the purging apparatus can purge each nozzle in accordance with an input command. When two or more of the nozzles are purged, the purge controller may make each of the two or more nozzles purged once in order and at least once again in order. After each of these nozzles is purged once and before it is purged at least once again, it may wait a predetermined time so that the air bubbles produced by the purging may vanish. After the predetermined time passes, similar purging may be repeated two or more times for the two or more nozzles. By purging the nozzles in such order, it is possible to effectively secure the time which the bubbles produced by purging take to vanish. The first time period may be one minute so that the bubbles produced by the last purging vanish securely.

The recorder may further include a timer for clocking the second time period after the last purging. If a command for operating the recording head is input in the recorder, the purge controller may control the purging by the purging apparatus, depending on the second period clocked by the timer, and the authorizing device may authorize the recording by the head when the first time period has passed after the purging controlled depending on the second period. This makes it possible to keep the head in good condition by controlling the purging depending on the second period, during which ink may dry and/or air bubbles may be produced in the ink in the head.

In accordance with a second aspect of the invention, another ink jet recorder is provided. The recorder includes a recording head having a plurality of ejection nozzles for ejecting ink onto a recording medium. The recorder also includes a purging apparatus which can purge the nozzles one after one to improve the ejection of ink from the nozzles. The recorder further includes a determining device, a purge controller and an authorizing device. The determining device determines the time having passed after the last purging. If there is a command for operating the head, the purge controller controls the purging depending on the length of the time determined by the determining device. The authorizing device can authorize the operation of the head, after or without purging, in accordance with the determination by the determining device. When two or more of the nozzles are purged, the controller makes the two or more nozzles purged once in order and at least once again in order. As stated above, the determining device determines the time which has passed after the last purging. If a very long time has not passed after the last purging, no further purging may be performed. If a long time has passed, additional purging may be performed. This controls the purging depending on the period during which ink may dry and/or air bubbles may be produced in the ink in the recording head. It is therefore possible to keep the head in good condition. After one of the nozzles is purged and before it is purged again, another may be purged. This shortens the standby time before recording, and prevents the bubbles from growing after purging.

In accordance with a third aspect of the invention, a still another ink jet recorder is provided. The recorder includes a recording head having a plurality of ejection nozzles for ejecting ink onto a recording medium. The recorder also includes a purging apparatus which can purge the nozzles one after one to improve the ejection of ink from the nozzles. The recorder further includes a purge controller for controlling the purging by the purging apparatus in such a manner that, when two or more of the nozzles are purged, they are purged once in order and at least once again in order. The method for purging nozzles of the conventional recorder a predetermined number of times includes purging one of the nozzles consecutively the predetermined number of times, and thereafter purging another consecutively the same number of times.

When two or more nozzles of the recorder according to the third aspect of the invention are purged, they are purged once in order and once again in order, and thereafter a series of similar purges may be repeated for them. Thus, after one of the nozzles is purged and before it is purged again, another is purged. It is therefore possible to lengthen the time interval between purges for each nozzle in comparison with the conventional recorder. Produced air bubbles can vanish during the lengthened interval. It is consequently possible to shorten the standby time, enabling the recording to start speedily. Because purging is performed again after air bubbles produced by the last purging vanish once, it is possible to prevent the bubbles from growing during the succeeding purging. In this case, the purge controller may make two or more of the nozzles purged once in order, then wait a predetermined time, and thereafter purged at least once again in order. By thus interposing the waiting time further, it is possible to prevent the bubbles more effectively from growing during the next purging.

In accordance with a fourth aspect of the invention, a yet another ink jet recorder is provided. The recorder includes a recording head having an ejection nozzle for ejecting ink onto a recording medium. The recorder also includes a purging apparatus for purging the nozzle. The recorder further includes a controller for controlling the purging apparatus in such a manner that the apparatus repeats first purging for the nozzle a first predetermined number of times, then halts until the predetermined time has passed which the air bubbles in the ink in the head take to vanish, and thereafter performs second purging for the nozzle a second predetermined number of times.

If a long time has passed after the last use of this recorder, it may be necessary to purge the ejection nozzle two or more times. On the other hand, in order to introduce ink initially to the recording head, it may also be necessary to purge the nozzle two or more times. The air bubbles produced by the first purging may stick to the walls and/or corners of the ink flow passage. In this case, by halting the purging between the first purging and the second purging to secure the time which the bubbles take to vanish, the bubbles can vanish during the halt. Because the second purging is performed thereafter, it is possible to inhibit the bubbles from growing at the next purging, and remove the bubbles which the first purging has not been able to remove. As a result, it is possible to secure high recording quality which overcomes the hindrance due to the bubbles.

This recorder may further include an ink supply for supplying the recording head with ink. The predetermined number of repetitions of the first purging may be necessary for introducing ink from the supply up to the front end of the ejection nozzle. In this case, ink reaches the front end of the nozzle before the halt. The strong surface tension of the ink at the nozzle end keeps ink from being drawn back toward the supply.

In accordance with a fifth aspect of the invention, a further ink jet recorder is provided. The recorder includes a recording head having an ejection nozzle for ejecting ink onto a recording medium to record on the medium. The head can be supplied with ink from an ink cartridge. The recorder also includes a suction cap for contact with the nozzle surface of the nozzle, and a suction pump for sucking ink out of the cartridge from the ejection side of the nozzle through the cap. The recorder further includes a purge controller for controlling the purging of the nozzle by the cap and the pump.

After the cartridge is replaced with a new one, the controller makes the nozzle purged the number of times which is necessary for introducing ink from the new cartridge up to the front end of the nozzle. Then, the controller halts the purging until the time passes which the air bubbles in the introduced ink take to vanish. Thereafter, the controller makes the nozzle purged a predetermined number of times. When ink is introduced initially from the substituted new cartridge into the recording head, air bubbles may enter the head together with the ink, but can vanish.

This recorder might include two or more nozzles for ejecting various color inks, and ink cartridges each connected to one of the nozzles.

In accordance with a sixth aspect of the invention, a further ink jet recorder is provided. The recorder includes a recording head having at least one ejection nozzle for ejecting ink onto a recording medium. The recorder also includes a purging apparatus for recovering the ejection of ink from the nozzle. The recorder further includes a timer and a controller. The timer clocks the time having passed after the last purging by the purging apparatus. The controller controls the head and the purging apparatus. If the clocked time exceeds a predetermined time period, the controller starts the head ejecting ink.

In accordance with a seventh aspect of the invention, a recording method of an ink jet recorder is provided. The recorder includes a recording head having an ejection nozzle. The recorder also includes a purging apparatus for purging the nozzle. The method includes the steps of:

clocking the time which has passed after the last purging by the purging apparatus;

judging whether the clocked time exceeds a predetermined time period or not, before the recording by the head;

starting the recording by the head if it is judged that the clocked time exceeds the period; and waiting for the recording until the clocked time exceed the period if it is judged that the clocked time does not exceed the period.

This recording method makes it possible to avoid the hindrance due to the air bubbles produced by purging, and is therefore very useful for an ink jet printer fitted with an apparatus for purging the nozzle of the recording head.

The recording method may also include the step of purging the nozzle before the recording by the recording head if it is judged that the clocked time exceeds the predetermined time period.

In accordance with an eighth aspect of the invention, a purging method of an ink jet recorder is provided. The recorder includes a recording head having a plurality of nozzles for ejecting different color inks. The recorder also includes a purging apparatus for purging the nozzles one by one. The method includes the steps of purging the nozzles once in order, and thereafter purging the purged nozzles at least once again in order.

When the nozzles are purged, this purging method makes it possible to effectively remove the air bubbles produced by the last purging, and to shorten the standby time before recording. Therefore, the method is very effective in the purge control of an ink jet printer or the like.

BRIEF DESCRIPTION OF THE DRAWINGS

Preferred embodiments of the invention are shown in the accompanying drawings, in which.

DETAILED DESCRIPTION OF PREFERRED EMBODIMENTS

Figure 1:
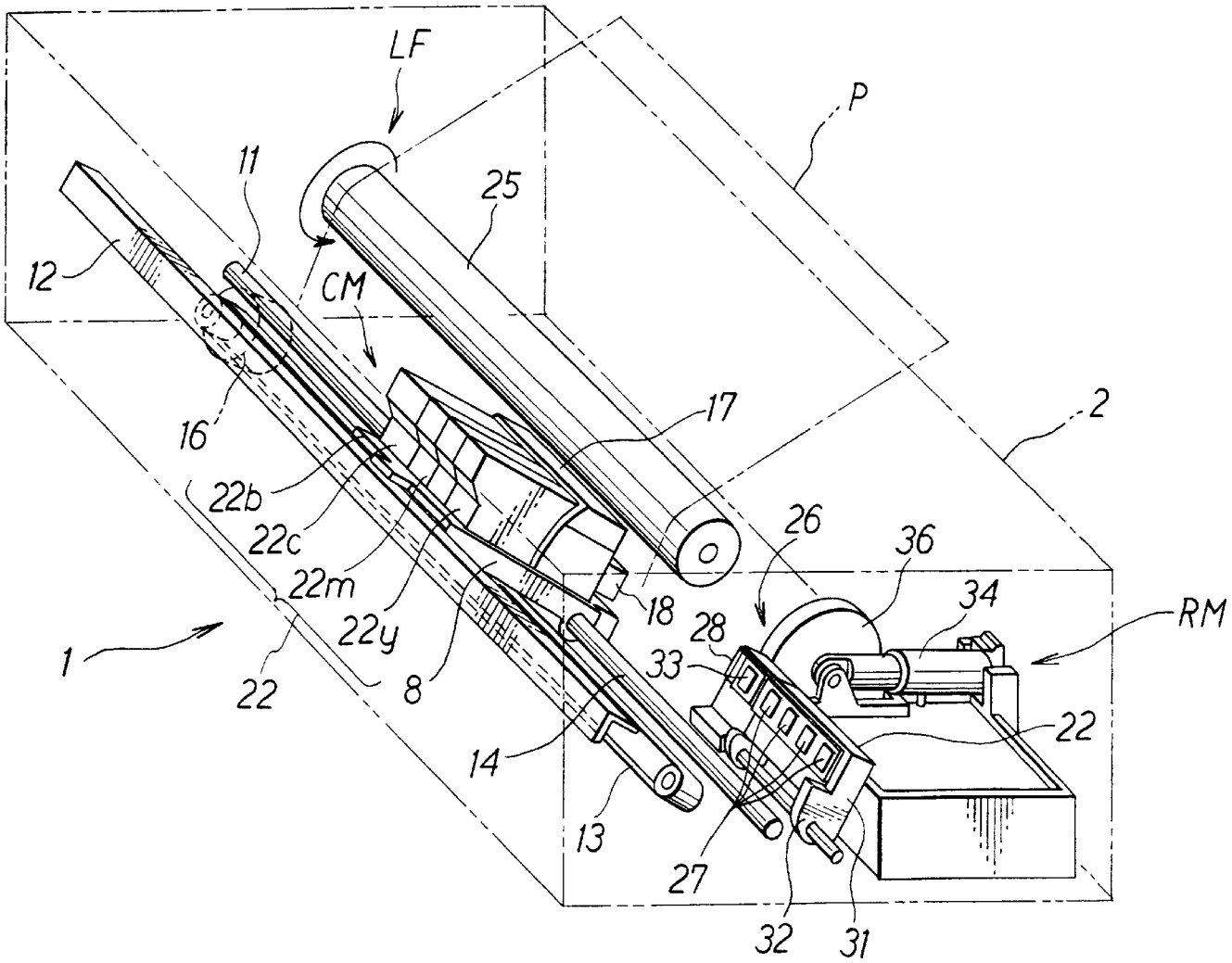
FIG. 1 is a perspective view of the internal structure of an ink jet printer according to the invention.

FIG. 1 shows the internal structure of an ink jet printer 1 according to an embodiment of the invention. The printer 1 includes a frame 2. A guide rod 11 and a guide member 12 extend horizontally in parallel, and are fixed to the frame 2. A carriage 8 is supported slidably on the rod 11 and member 12, and is fixed to a timing belt 13, which can be driven by a carriage drive motor (CR motor) 16 in order for the carriage 8 to reciprocate along the rod 11 and member 12. Mounted on the carriage 8 is an ink jet type recording head unit 17, which includes a recording head 18 for printing a recording sheet or medium P by ejecting droplets of ink of four colors (cyanogen C, magenta M, yellow Y and black B) onto the sheet.

Figure 2:
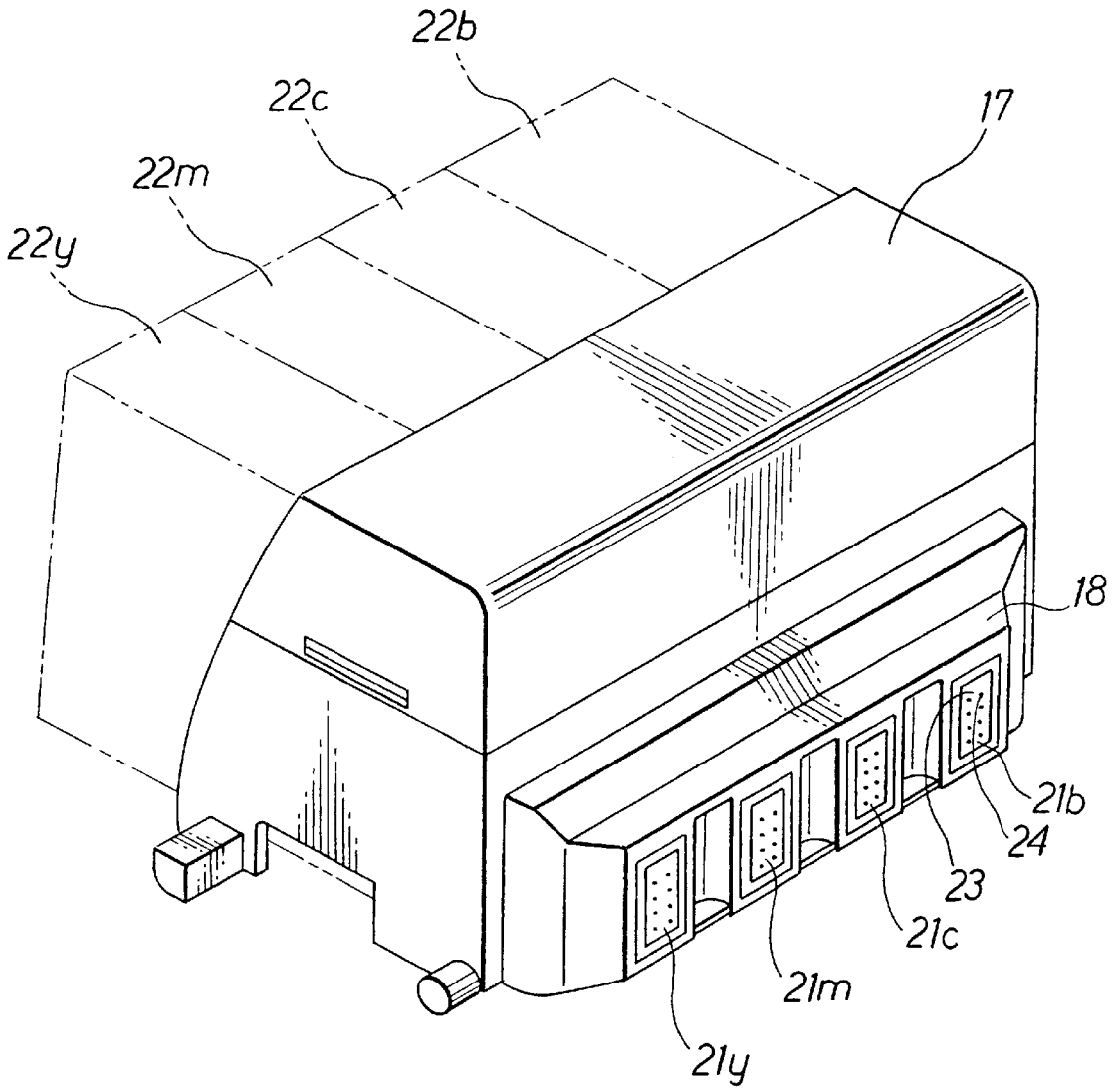
FIG. 2 is an enlarged perspective view of the recording head unit of the printer shown in FIG. 1.

As shown in FIG. 2, the recording head 18 has injection nozzles 21 (21*y*, 21*m*, 21*c*, 21*b*). Mounted removably on the back side of the head unit 17 are ink cartridges 22 (22*y*, 22*m*, 22*c*, 22*b*) for supplying the nozzles 21*y*, 21*m*, 21*c* and 21*b*, respectively, with inks. Each nozzle 21 has a nozzle surface 23, where a number of ejection holes 24 open. The holes 24 may be 64 in number.

Back to FIG. 1, the recording head 18 faces a feed mechanism LF for feeding a recording sheet P. The mechanism LF includes a platen roller 25 extending in parallel to the guide rod 11 and member 12. The roller 25 is supported by the frame 2, and can be rotated by a feed motor (LF motor) 30 (FIG. 5) to feed a recording sheet P.

Positioned on one side of the feed mechanism LF is a maintenance/recovery mechanism RM for maintaining and recovering ejection of ink from the recording head 18. This mechanism RM includes a suction device 26 for eliminating defective ejection of ink, which may occur when the ink on or in the head 18 dries, when air bubbles are produced in the head, or when droplets of ink stick to the head nozzle surfaces 23. The mechanism RM also includes preservation caps 27 each for covering one of the nozzle surfaces 23 to keep it wet while the printer 1 is not used. The mechanism RM further includes a wiper 28 for wiping the nozzle surfaces 23.

Figure 3:
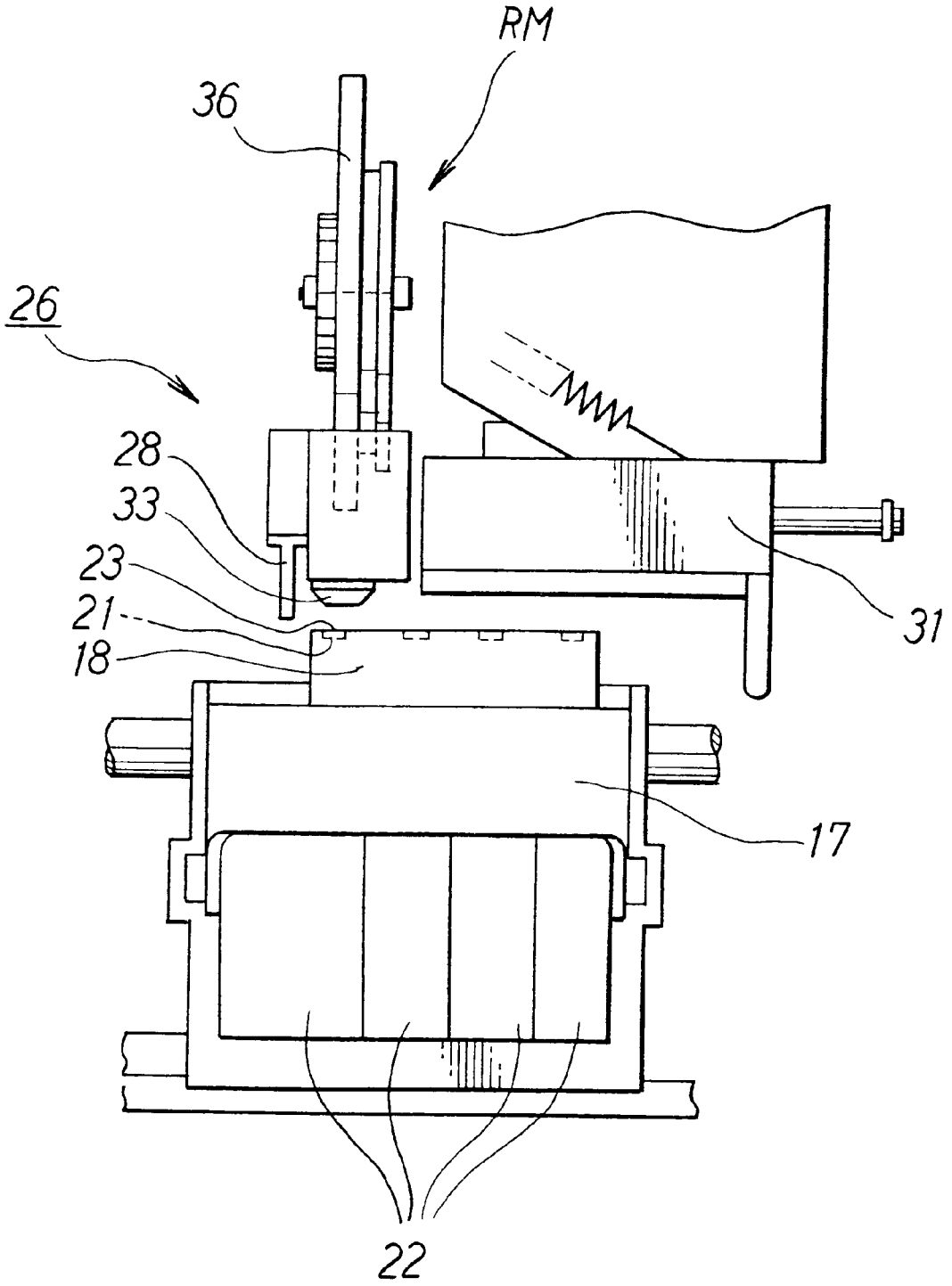
FIG. 3 is an enlarged partial view of a maintenance/recovery mechanism of the printer shown in FIG. 1.
Figure 5:
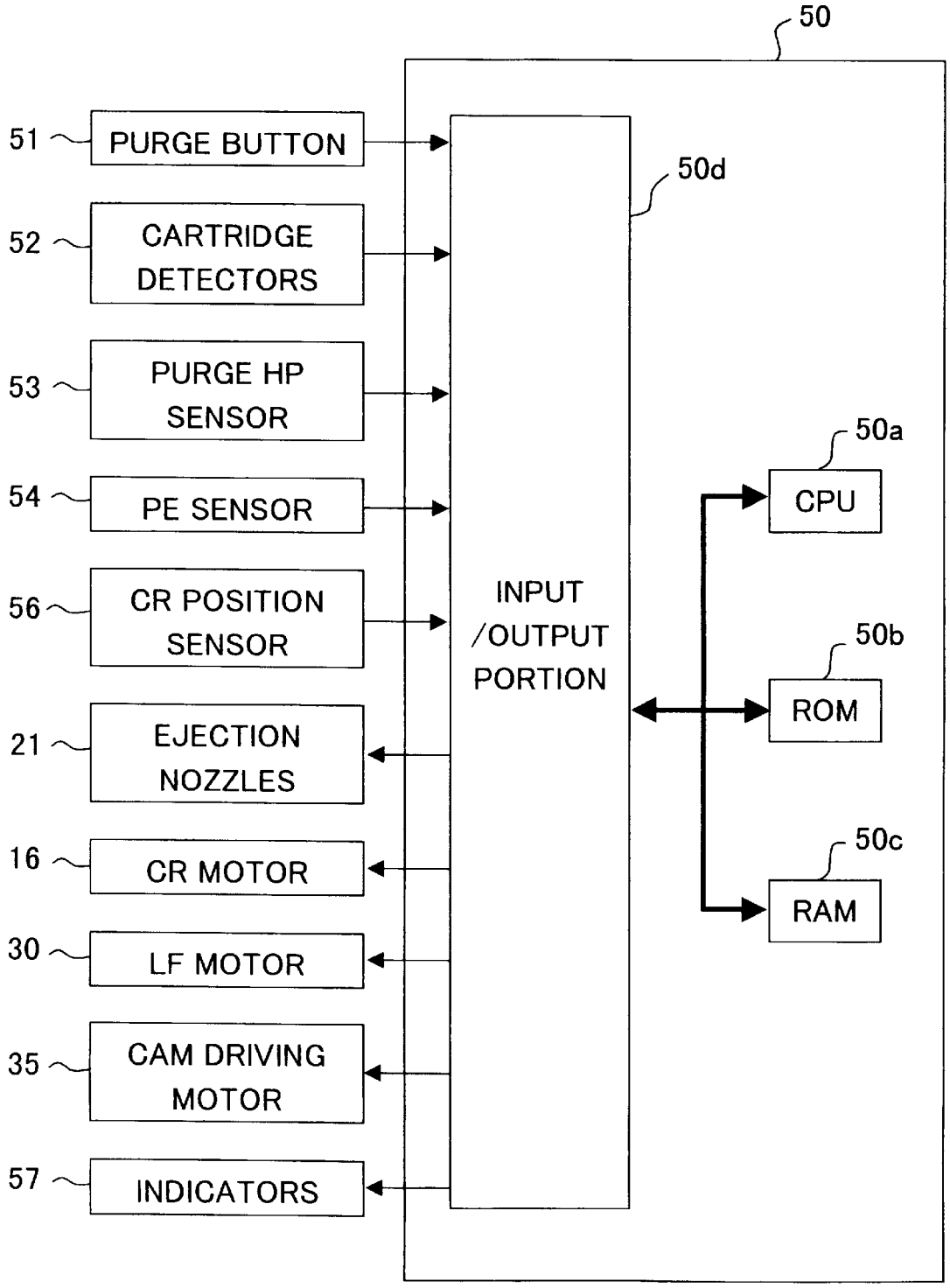
FIG. 5 is a block diagram of the electric structure or construction of the printer.

As shown in FIGS. 1 and 3, the suction device 26 includes a suction cap 33 which can move into and out of close contact with each nozzle surface 21 of the recording head 18. The device 26 also includes a suction pump 34 (FIG. 1) for sucking ink through the cap 33 from the head 18 while this cap is in close contact with the head. The maintenance/recovery mechanism RM also includes a cam 36 which can be driven by a cam drive motor 35 (FIG. 5). The cam 36 can move the suction cap 33 and the wiper 28 forward toward the recording head 18 and backward, and drive the pump 34 to purge the head through the suction cap.

Figure 4:
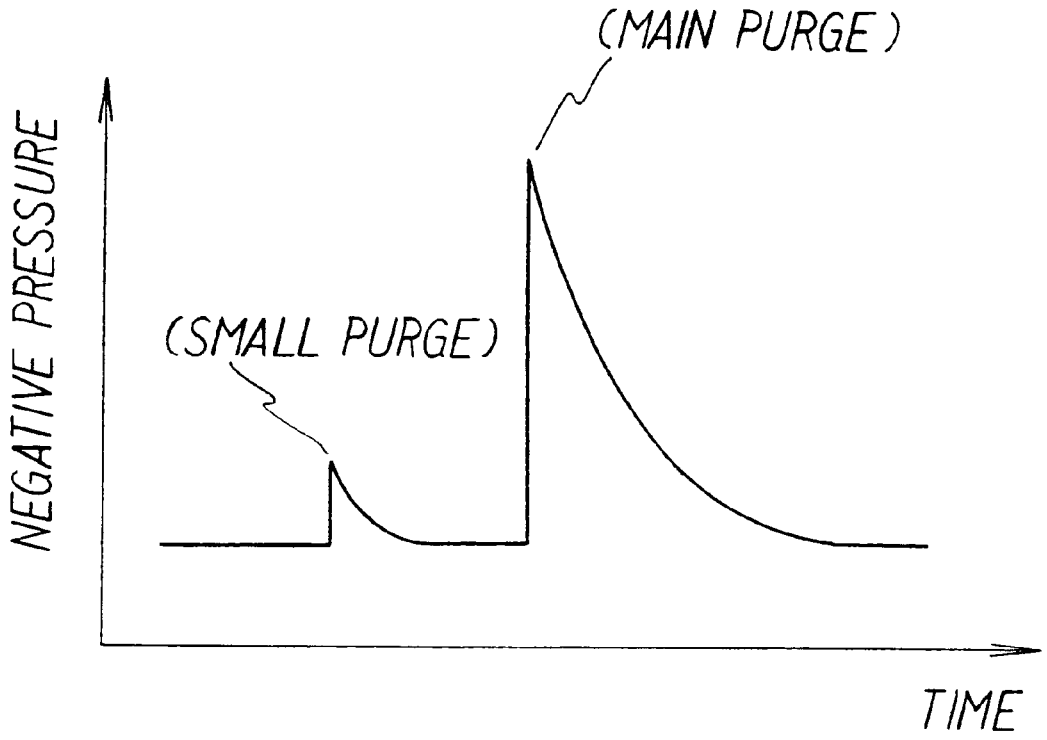
FIG. 4 is a graph showing the change in the negative pressure developed by the suction pump of the printer while the recording head of the printer is purged.

Specifically, while the pump 34 is reciprocating once, a cycle of suction is performed as shown in FIG. 4. The cycle includes a small purge with a low negative pressure and a main purge with a higher negative pressure. The small purge is followed by the main purge. Each ejection nozzle 21 may be purged normally by three cycles of the purges.

Before the printer 1 is delivered from the factory or plant where it is made, the recording head 18 is filled with liquid for keeping the inside of the head wet. The suction device 26 also functions to suck and remove the liquid from the head 18, and to introduce ink from a substituted new ink cartridge 22 into the head.

FIG. 5 shows the electric structure of the printer 1.

The printer 1 includes a control unit (ECU) 50, which is a well known microcomputer including a CPU 50*a*, a ROM 50*b*, a RAM 50*c* and an input/output port 50*d*. The control 50 controls the operation of the printer 1 in a manner for known printers. As will be apparent from the description of the operation, the control unit 50 includes a device for measuring the time, i.e. a timer from a purge till authorization to start a recording action, a device for measuring the time passing after a purge, determination device each for determining one of these times, an authorization device for making a recording action stand by and/or authorizing to start a recording action, a purge control device for controlling the drive of the motor 35 of the suction device 26, and other control device which are necessary for the printer 1.

The input/output port 50*d* is connected to a purge button 51 and other switches, cartridge detectors 52, a purge HP sensor 53, a PE sensor 54, a CR position sensor 56, etc. The purge button 51 can be pushed to instruct the control 50 to make the suction device 26 perform suction. Each cartridge detector 52 can detect an ink cartridge 22 being present on and absent from the head unit 17. The purge HP sensor 53 can sense the pump 34 being at its home position. The PE sensor 54 can sense the front end of a recording sheet P being fed. The CR position sensor 56 can sense the position of the carriage 8.

The input/output port 50*d* is also connected to the nozzles 21, which are actuators for ejecting ink, the CR motor 16, the LF motor 30, the cam drive motor 35 for driving the cam 36, which can drive the suction device 26, and indicators 57 for indicating the present operating conditions etc.

Figure 6:
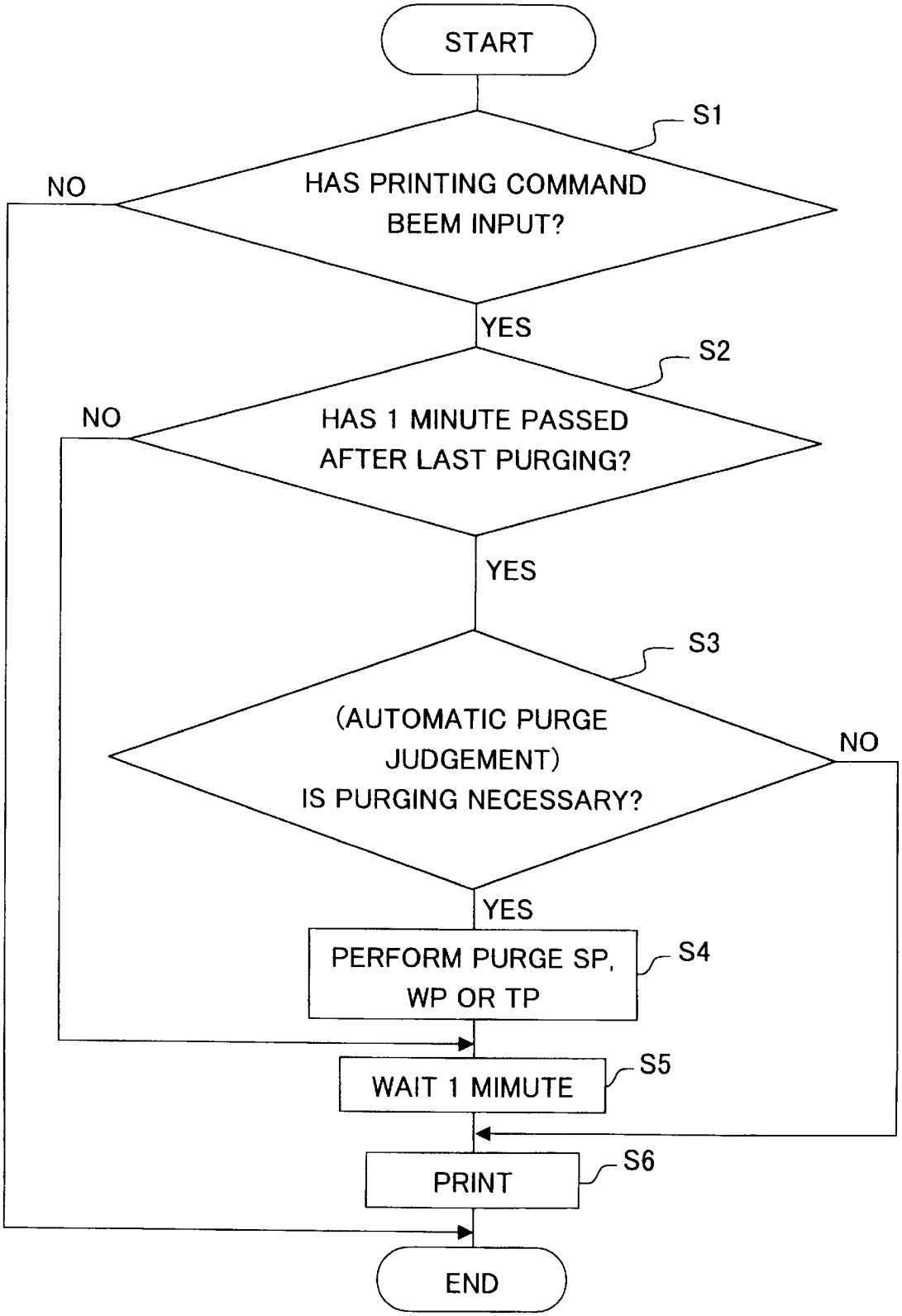
FIG. 6 is a flowchart of a control process for purging the recording head of the printer.

FIG. 6 shows a process of controlling the printer 1. For example, one of the nozzles 21 is purged as follows.

With reference to FIG. 6, it is judged whether a recording (printing) command has been input or not (S1). If it is judged that a recording command has been input (S1: yes), it is judged whether one minute has passed after the nozzle 21 was purged last (S2). If it is judged that one minute has not passed after the last cycle of the purges (S2: no), the printer waits one minute for recording (S5). Thereafter, the nozzle 21 ejects ink for recording (S6), and then the process ends once. If it is judged that one minute has passed after the last cycle of the purges (S2: yes), an automatic purge judgment is made (S3).

The automatic purge judgment is to judge how many cycles of the purges to perform for the nozzle 21. The judgment may be based on the number of days or period after the nozzle 21 is purged last. If a very long period which is longer than one minute has not passed after the last cycle of the purges, the nozzle 21 may not be purged. If a short period more than one minute has passed after the last cycle of the purges, one cycle of the purges (single purge SP) is performed. If a longer period has passed, two cycles of the purges (double purge WP) are performed. If a still longer period has passed, three cycles of the purges (triple purge TP) are performed.

If the automatic purge judgment judges that a very long period has not passed after the nozzle 21 was purged last and it is therefore not necessary to purge the nozzle (S3: no), the recording is continued (S6). Then, the process ends once. If this judgment judges that a predetermined period has passed after the last purge and it is therefore necessary to purge the nozzle 21 (S3: yes), the nozzle 21 is moved to the purge position in front of the suction cap 33. Specifically, the nozzle 21 is moved properly to the purge position by the CR motor 16 being driven while the position of the carriage 8 is sensed by the CR position sensor 56. Then, one, two or three cycles of the purges are performed (S4) depending on the period after the last purge (S4) determination of the Automatic Purge Judge (S3). Thereafter, the printer 1 is forced to stand by for one minute (S5), and then recording is performed (S6). Then, the process ends once.

The user may find one or more dots missing from a printed sheet. In order to recover the missing dot or dots, or introduce new ink from a substituted cartridge 22 into the recording head 18, the user may operate a switch to purge the head 18. In such cases, even if a recording command is input soon after the head 18 is purged (S1: yes), recording is performed after it is judged that one minute has passed after the purging. Thus, if a recording command is input, purging is performed as the need arises. Besides, recording does not start soon after purging, but the printer waits one minute for recording. While the printer is waiting, the air bubbles produced by the rapid or strong ink flow due to the purging vanish. It is therefore possible to keep the ejecting characteristic good for better recording.

Figure 7:
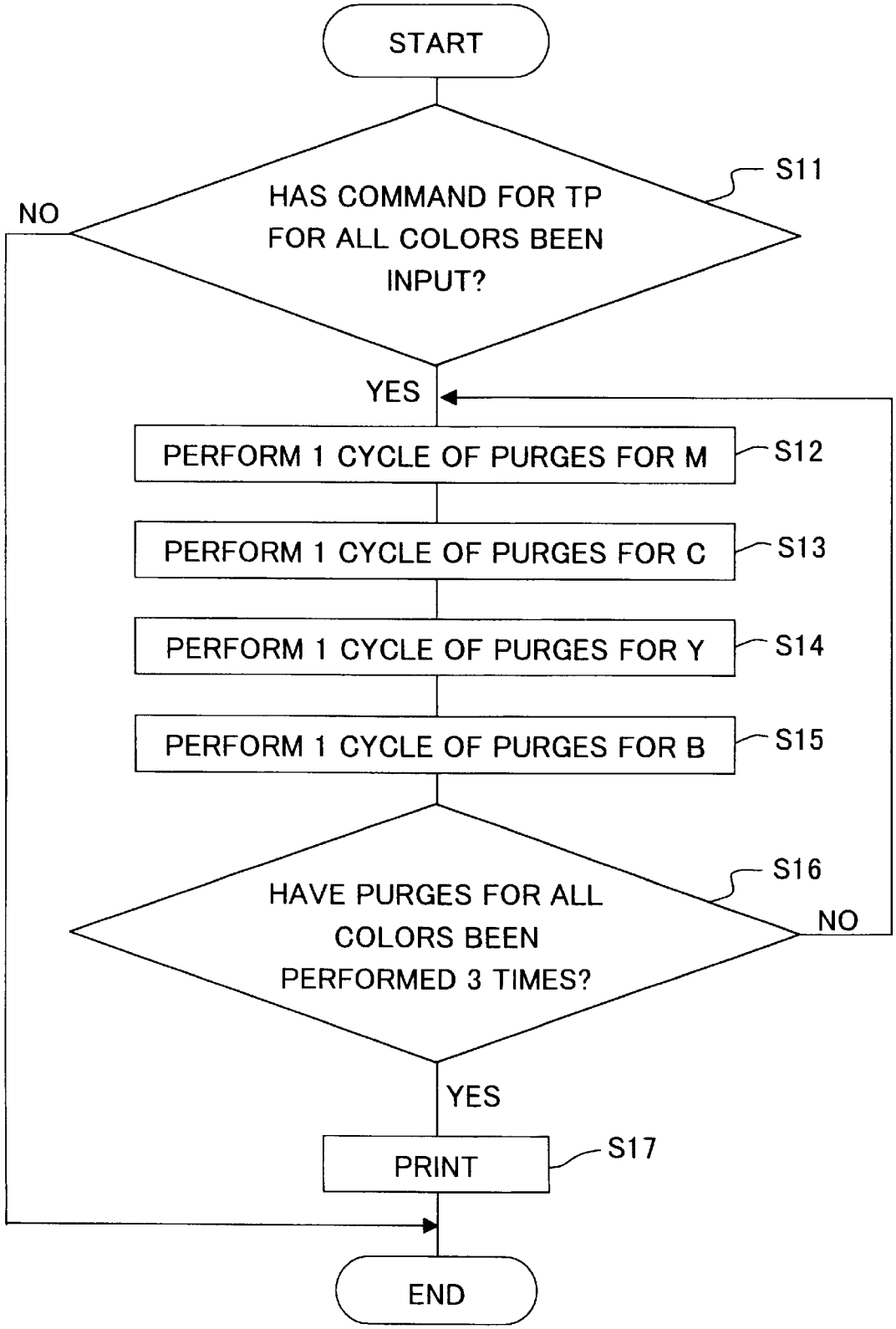
FIG. 7 is a flowchart of a control process for purging all the ejection nozzles of the printer.

FIG. 7 shows the control process in a case where a command for three cycles of the purges (TP) is input for the nozzles 21 at step S4 after the automatic purge judgment (S3). With reference to FIG. 7, it is judged whether a command for three cycles of the purges (TP) has been input (S11) as a result of the automatic purge judgment. If it is judged that a command for TP has not been input (S11: no), the process ends once, and another process starts. If it is judged that a command for TP has been input (S11: yes), one cycle of the purges is performed at a time for the nozzles 21 one after one (S12–S15). For example, first, one cycle of the purges is performed for the nozzle 21*m* (S12). Next, one cycle of the purges is performed for the nozzle 21*c* (S13). Next, one cycle of the purges is performed for the nozzle 21*y* (S14). Next, one cycle of the purges is performed for the nozzle 21*b* (S15). It is then judged if one cycle of the purges has been performed three times in total for each nozzle 21 (S16). If not yet (S16: no), one cycle of the purges is repeated (S12–S15). If the purges have been performed already three times (S16: yes), recording is performed (S17), and then the process ends once.

Thus, if there is a command for three cycles of the purges for all the nozzles 21, one cycle is performed at a time for each of the nozzles 21 in order, and followed by two more cycles performed likewise. In other words, a cycle of the purges is repeated three times. Consequently, more air bubbles vanish than in a conventional case where purging is performed consecutively three times for the same nozzle.

In other words, after one of the nozzles 21, which may be the nozzle 21*m,* as purged last and before it is purged this time, another nozzle 21, which may be the nozzle 21*c,* is purged. Substantially, the period between the two cycles of the purges of that nozzle (21*m*) is a pause for which the nozzle is not purged. During the pause, air bubbles produced by the last cycle of the purges vanish. It is therefore possible to keep the ejecting characteristic good for better recording.

Figure 8:
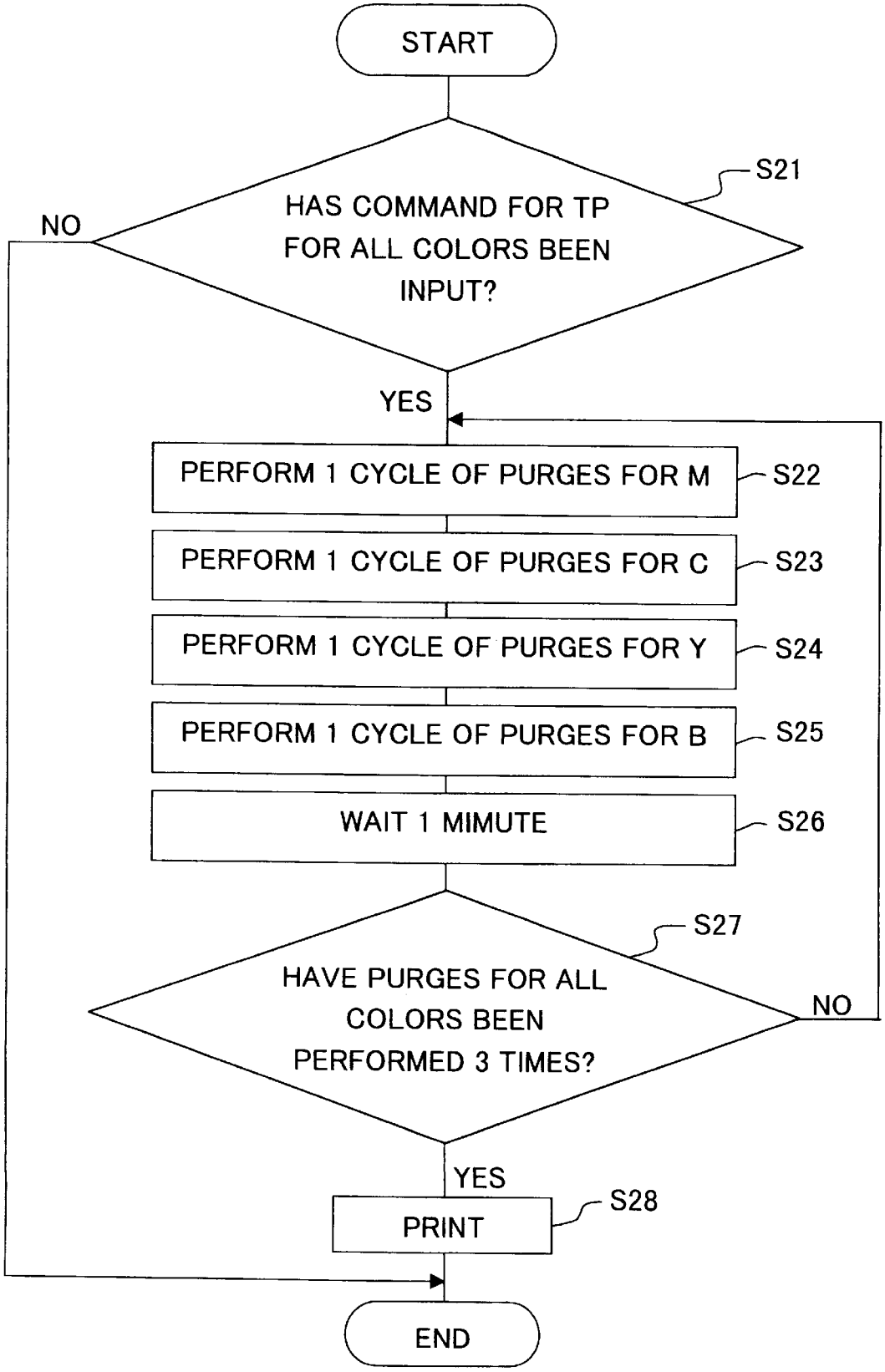
FIG. 8 is a flowchart of another control process for purging all the ejection nozzles.

FIG. 8 shows the control process for causing air bubbles to vanish more effectively when purging is performed (S4) after the automatic purge judgment (S3).

With reference to FIG. 8, it is judged if a command for three cycles of the purges (TP) has been input (S21) as a result of the automatic purge judgment. If it is judged that a command for TP has not been input (S21: no), the process ends once, and then another process starts. If it is judged that a command for TP has been input (S21: yes), one cycle of the purges is performed at a time for the nozzles 21 one after one (S22–S25), as is the case with FIG. 7. Thereafter, the printer is forced to stand by for one minute (S26). During this stand-by time, the next purging and recording are prohibited. It is then judged if one cycle of the purges has been performed three times in total for all the nozzles 21 (S27). If not yet (S27: no), one cycle of the purges (S22–S25) and the forced standby or waiting (S26) are repeated. If the purges have been performed three times (S27: yes), recording is performed (S28), and then the process ends once.

Thus, as is the case with FIG. 7, if there is a command for three cycles of the purges for all the nozzles 21, one cycle at a time is repeated three times in total for the nozzles. Consequently, more air bubbles vanish than in the conventional case where purging is performed consecutively three times for the same nozzle. In particular, after a series of purges for all the nozzles 21, the printer 1 is forced to stand by for one minute. It is therefore possible to make the bubbles vanish securely, thereby improving the recording quality further.

The control processes of FIGS. 7 and 8 may be modified for two, four or more cycles of the purges. The processes of FIGS. 7 and 8 might be performed, not only for purging (S4) after the automatic purge judgment (S3), but also independently as is the case when the user specifies purging for the recording head by operating the switch, to recover the missing dot or dots found by the user, or to introduce new ink from a substituted cartridge into the head. In such cases, if purging is specified for the two or more nozzles in which dots are missing, or for the two or more nozzles associated with substituted ink cartridges, only these nozzles can be purged likewise.

The stand-by time might otherwise not be limited to one minute, but be determined depending on the form of a recording head and/or the form of the ink supply paths in the head.

The invention can be applied to not only ink jet printers but also facsimile terminal equipment and other recorders.

Figure 9:
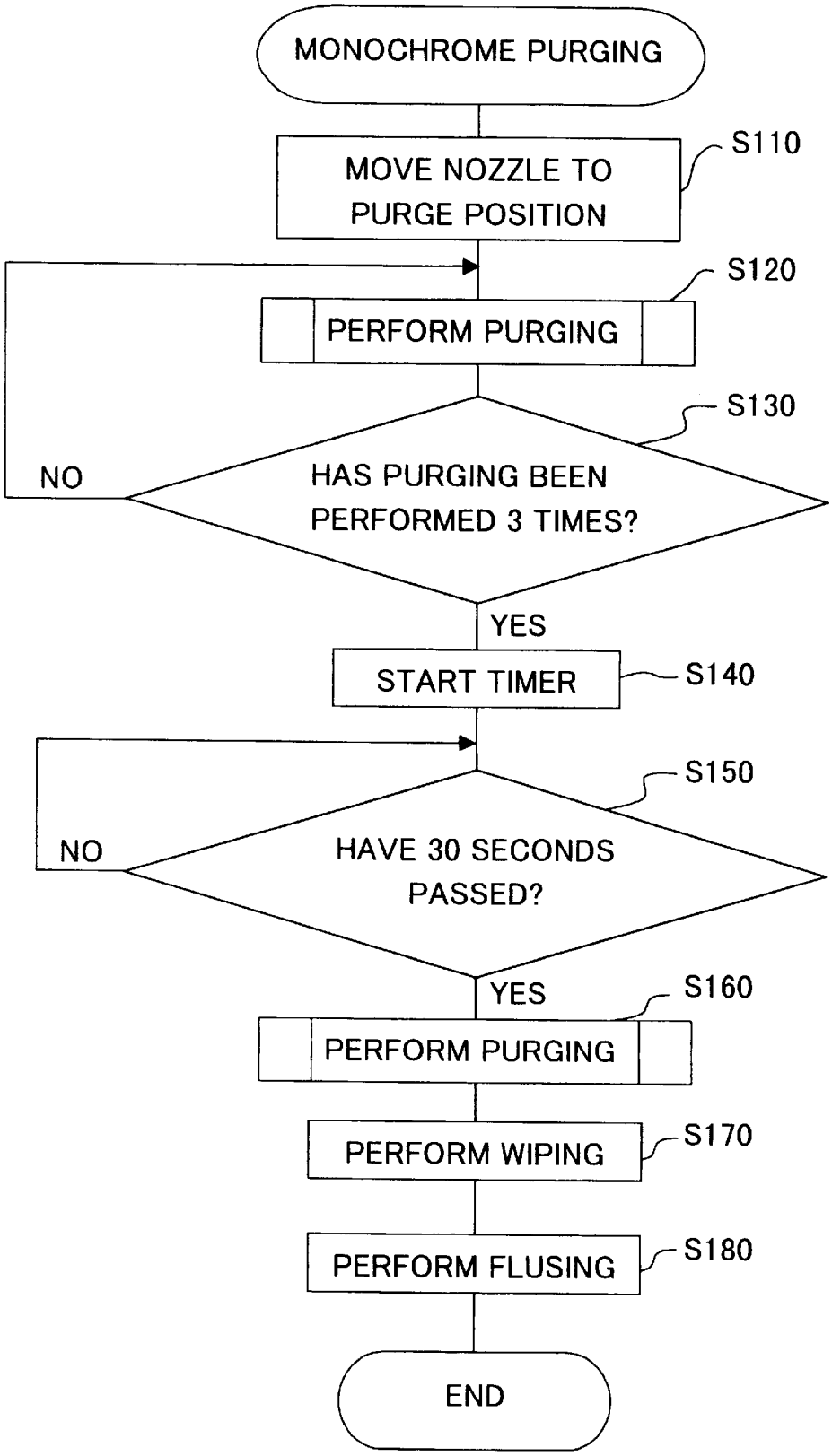
FIG. 9 is a flowchart of a control process for purging, wiping and flushing the recording head of the printer.
Figure 10:
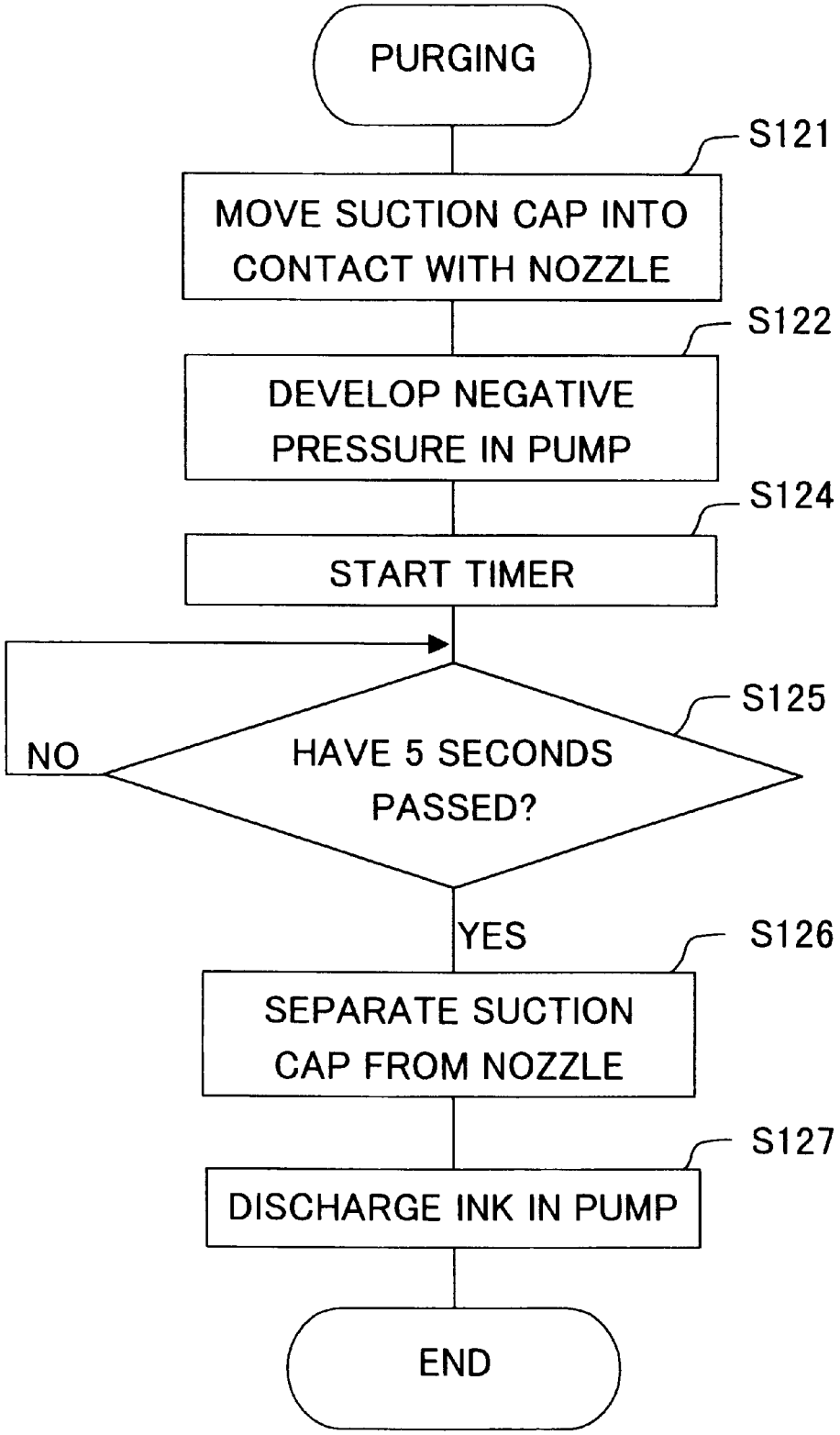
FIG. 10 is a flowchart showing details of the purging steps of FIG. 9.

FIGS. 9 and 10 show the control process performed by the control 50 if one of predetermined conditions is satisfied. One of the conditions is that it is commanded to purge the nozzle 21 designated with the purge button 51. Another condition is that one of the cartridge detectors 52 detects the associated cartridge 22 having been replaced with a new cartridge.

With reference to FIG. 9, after this process starts, the nozzle 21 to be purged is moved to the purge position in front of the suction cap 33 (S110). In this position, the nozzle 21 is purged (S120). This purging (S120) includes, as shown in FIG. 10, moving the suction cap 33 into contact with the nozzle surface 23 of the nozzle 21 (S121), and driving the pump 34 to develop negative pressure (S122). At this stage, the cap 33 communicates with the pump 34, and therefore the negative pressure is applied to the interior of the nozzle 21. Then, a timer is started clocking or timing the suction of ink from the nozzle 21 (S124). The suction is continued for a predetermined period, which may be five seconds (S125: no). While ink is sucked from the nozzle 21, the sucked ink is collected once in the pump 34. When the period (5 seconds) has passed (S125: yes), the cap 33 is separated from the nozzle surface 23 (S126). Thereafter, the ink in the pump 34 is discharged (S127).

Back to FIG. 9, after the purging thus ends (S120), it is judged if the purging has been performed three times (S130). If not yet (S130: no), the purging is repeated (S120). Three cycles of the purges are sufficient to fill ink into the ink passage extending from the cartridge 22 and up to the front end of the nozzle 21, and to make part of the ink flow into the suction cap 33. If the purging has been performed three times (S130: yes), the timer starts (S140). Then, the printer stands by for the time which air bubbles take to vanish. The stand-by time may be thirty seconds (S150: no). If the stand-by time (30 seconds) has passed (S150: yes) after the timer started (S140), the nozzle 21 is purged again (S160). This purging is similar to the previous purging (S120), and will accordingly not be explained. After this purging (S160) ends, the carriage 8 is moved in order for the wiper 28 to wipe away the ink on the nozzle surface 23 of the just purged nozzle 21 (S170). Then, the carriage 8 is moved to position all the nozzles 21 in front of an ink receiver 29, which is fitted in the frame 2. In this position, the nozzles 21 perform ejection in order to be flushed so that the air bubbles etc. are removed completely out of the nozzles 21 (S180). Then, the process ends.

When each cartridge 22 is replaced with a new one, air may enter the joint or connection between the new cartridge and the recording head 18. This air may form bubbles, which may collect on the walls of the associated ink passage or in the corners of the passage, or near them. As stated above, purging is performed a number of times which is necessary for introducing ink up to the front end of the nozzle 21 being purged, and the purging is stopped once. Therefore, even if air bubbles collect in the associated ink passage, they keep small and do not become very large. Most of the bubbles are absorbed easily into ink and vanish. After most of the bubbles are absorbed into ink and vanish, purging is performed again. It is therefore possible to remove the bubbles remaining on the passage walls or in the passage corners, or near them, thereby completing the introduction of ink into the nozzle 21.

Because purging is performed the number of times which is necessary for introducing ink up to the front end of the nozzle 21 being purged, the ink at the front end develops strong surface tension, which keeps the ink from being drawn back toward the associated cartridge 22. Therefore, even if purging is performed again, no air bubble is produced newly on the inner wall of the nozzle 21.

Figure 11A:
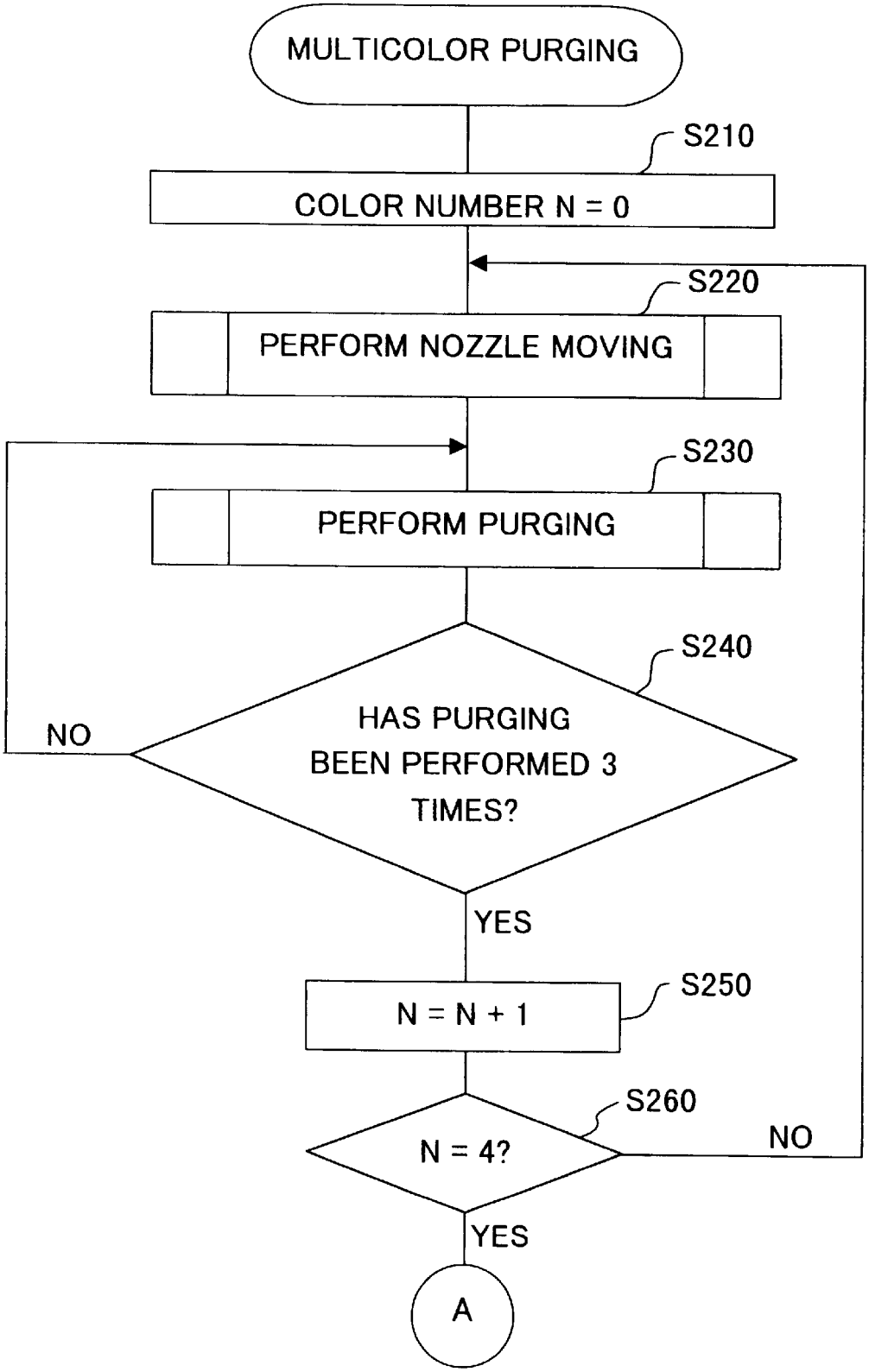
FIGS. 11A and 11B are a flowchart of a control process for purging, wiping and flushing all the ejection nozzles of the printer.
Figure 11B:
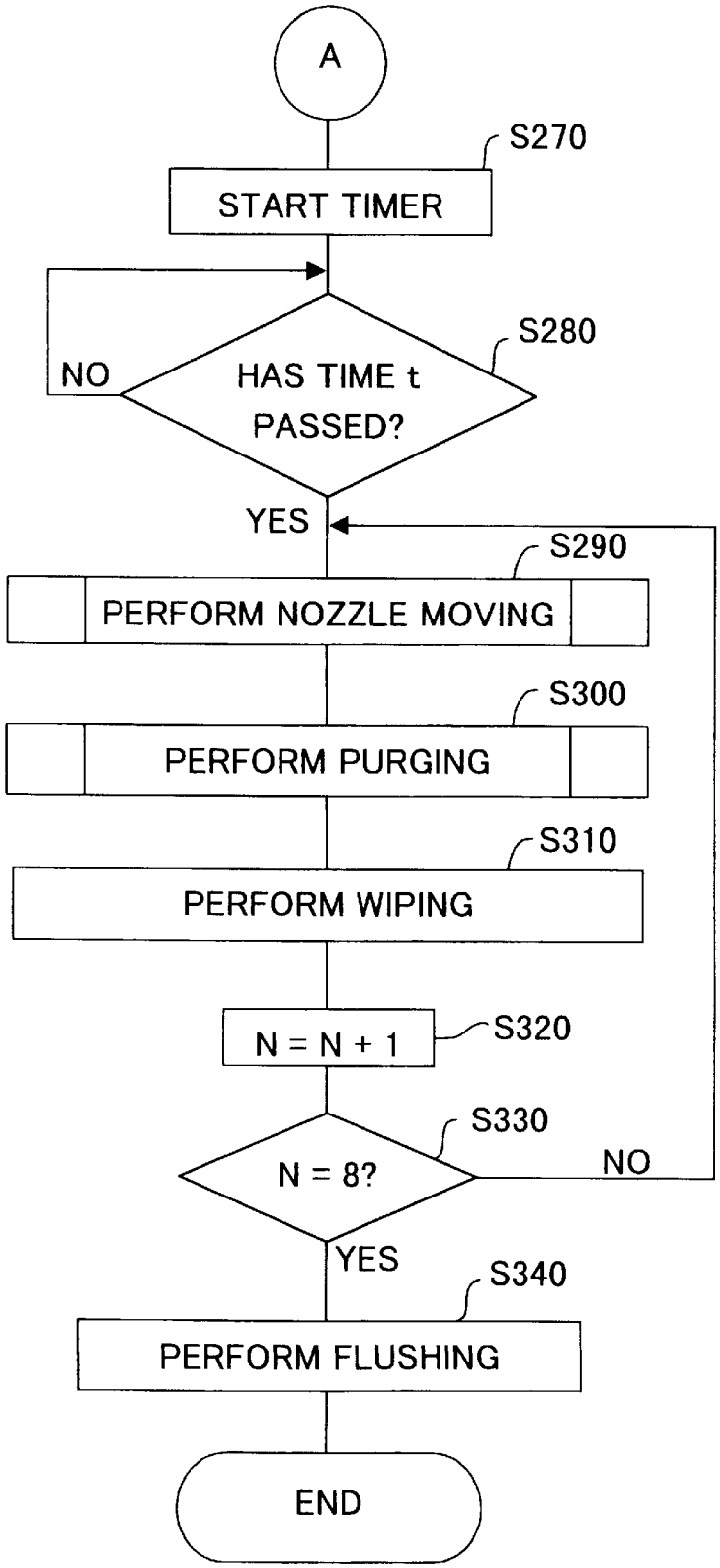
Figure 12:
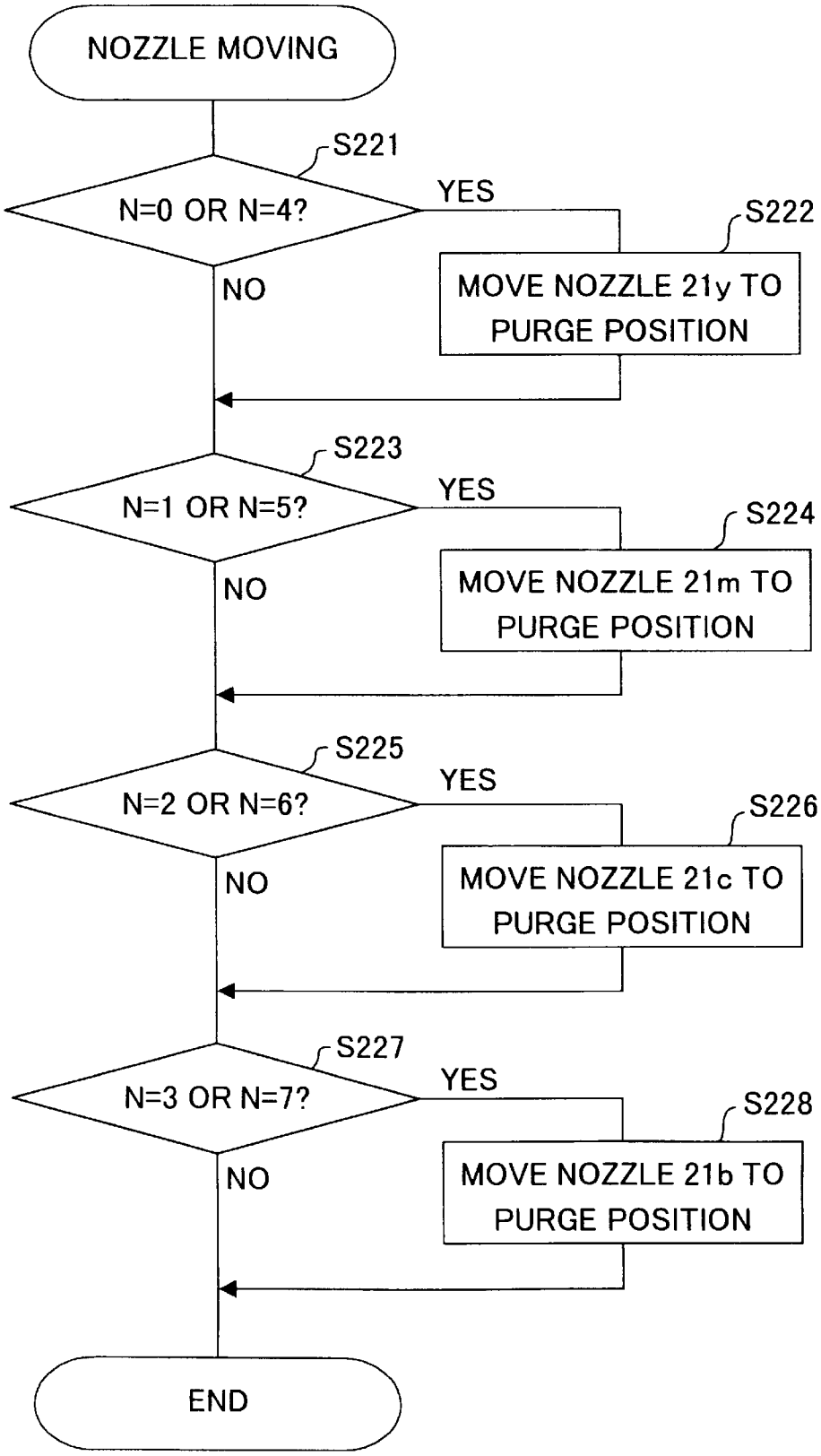
FIG. 12 is a flowchart showing details of the nozzle moving steps of FIGS. 11A and 11B.
Figure 13:
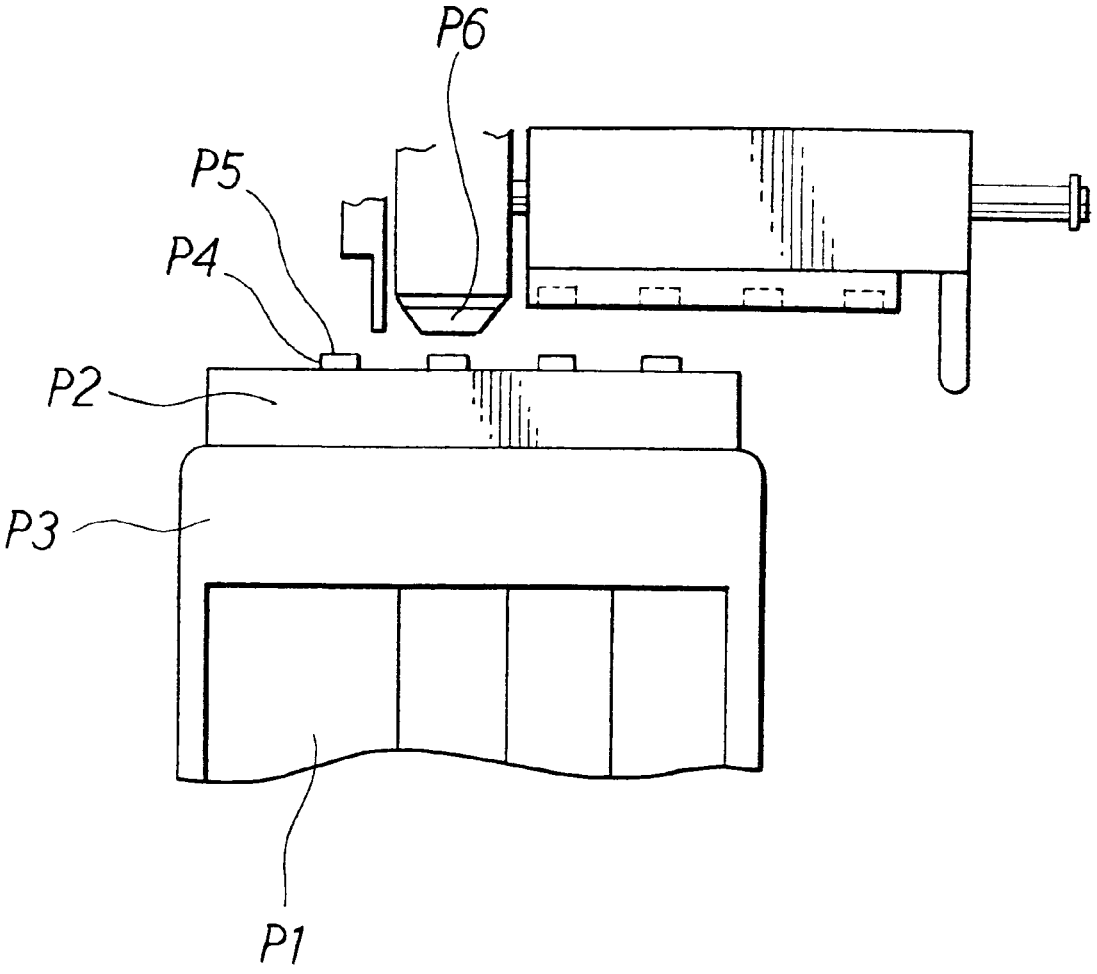
Fig. 13 PRIOR ART
FIG. 13 is a partial view of a conventional ink jet printer.

FIGS. 11 and 12 show the control process performed by the control 50 to purge all the four nozzles 21 if all of them are designated with the purge button 51, or after all the cartridges 22 are replaced.

With reference to FIGS. 11A and B, after this process starts, the color number N is set first to 0 (S210). Then, one of the nozzles 21 is moved to the purge position (S220). FIG. 12 shows details of this nozzle moving step (S220 similar to the later step 290).

With reference to FIG. 12, it is first judged whether the color number N is 0 or not, or whether the number N is 4 or not (S221). If N is 0 or 4, the nozzle 21*y* for yellow ink is moved to the purge position (S222). Next, it is judged if the color number N is 1 or if the number N is 5 (S223). If N is 1 or 5, the nozzle 21*m* for magenta ink is moved to the purge position (S224). Next, it is judged if the color number N is 2 or if the number N is 6 (S225). If N is 2 or 6, the nozzle 21*c* for cyanogen ink is moved to the purge position (S226). Last, it is judged if the color number N is 3 or if the number N is 7 (S227). If N is 3 or 7, the nozzle 21*b* for blank ink is moved to the purge position (S228).

Back to FIGS. 11A and 11B, after one of the nozzles 21 is thus moved to the predetermined position (S220), it is purged there (S230). This purging is similar to the foregoing purging (S120), and will accordingly not be explained. Next, it is judged if this nozzle 21 has been purged (S230) three times (S240). If not yet (S240: no), the nozzle 21 is purged again (S230). If the nozzle 21 has been purged (S230) three times (S240: yes), 1 is added to the color number N (S250). Then, it is judged if the color number N is 4 (S260). If N is not 4 (S260: no), the steps S220, S230, S240, S250 and S260 are repeated to purge another nozzle 21. If N is 4, the timer starts (S270) and the printer waits until a time t passes. The time t is predetermined as follows.

In advance, estimates are made of the time t1 required for performing the steps S290, S300, S310, S320 and S330 for the preceding nozzle or nozzles 21 and the time t2 required for performing the steps S220, S230, S240, S250 and S260 for the succeeding nozzle or nozzles 21. A time T1 is defined as 30 seconds minus t1. A time T2 is defined as 30 seconds minus t2. The time T1 or T2 whichever is longer is set as the time t. If the time t is less than 0, it is made 0 (t=0). For example, the steps S290–S330 are performed for no nozzle 21 before they are performed for the nozzle 21*y*. Therefore, the t1 for the nozzle 21*y* is 0. The nozzle 21*y* waits the time t2 while the steps S220, S230, S240, S250 and S260 are performed for the other three nozzles 21*m*, 21*c* and 21*b*. Therefore, the waiting time t is 30 seconds minus t2.

If it is judged that the time t has passed (S280: yes) after the timer started, the appropriate nozzle 21 is moved to the purge position (S290), where it is then purged (S300).

That is to say, by stopping the printer once until the time t passes after it is judged at the step S260 that the color number N is 4 (yes), it is possible to put an interval of at least 30 seconds after any nozzle 21 is purged last (S230) and until this nozzle is purged next (S300).

The nozzle moving step S290 is similar to the nozzle moving step S220, and will not be explained. The purging step S300 is similar to the purging step S230, and will not be explained.

The nozzle 21 purged at the step S300 is wiped (S310), and then the color number N increments by 1 (S320). Next, it is judged if the number N is 8 (S330). If not (S330: no), the steps S290–S330 are repeated. If N is 8 (S330: yes), the air bubbles are removed completely from the ink in all the nozzles 21, and the nozzles are flushed to prevent color mixture (S340). Then, the multicolor purging method ends.

Thus, two or more of the nozzles 21 are purged in order each a number of times which is necessary for introducing ink up to the front end of the nozzle 21 being purged. It is therefore possible to shorten the waiting time, which might otherwise be 30 seconds. This prevents the user from waiting a long time.

In order to introduce ink up to the front end of the nozzle 21, the nozzle is purged consecutively three times (S120 and S230). The number of times or cycles of the purges might, however, be set suitably, depending on the capacity of the pump. The fewer the cycles of the purges are, the shorter the user's waiting time is. It is therefore preferable that the cycles are fewer.

The time which the air bubbles in the ink take to vanish after ink is introduced up to the front end of the nozzle 21 is made 30 seconds. The time might, however, be any seconds as far as the bubbles in the ink can vanish. The shorter the time is, the shorter the user's waiting time is.

In the control process of FIGS. 11 and 12, all the nozzles 21 are purged. The invention can also be applied to initial purging for introduction of ink to the nozzle or nozzles 21 associated with any substituted cartridge or cartridges 22. For example, after one of the nozzles 21 is purged the number of times which is necessary for introducing ink up to the nozzle surface 23 of this nozzle, and while the air bubbles in the nozzle 21 are vanishing, another nozzle 21 is purged. This makes it possible to introduce ink into the two nozzles 21 in a shorter time.

When the nozzles 21 are purged, the single timer is used to clock the time which the air bubbles in the ink take to vanish (S270). Instead, the printer might include four timers each associated with one of the nozzles 21. Each of these timers might start between the steps S240 and S250, and clock the time which the bubbles in the ink in the associated nozzle 21 take to vanish. In other words, any method can be used to clock the time which the bubbles take to vanish.

In the above embodiments, the control unit has been functioned as the judging device for judging whether a first time period has passed or not after the last purging by the purging apparatus, and the authorization device for making a recording action stand by and/or authorizing to start a recording action. However, these devices may be mechanical devices like a mechanical switch, and may be provided in the ink jet printer together with the control unit.

What is claimed is:

1. An ink jet recorder comprising:

a recording head having an ejection nozzle for ejecting ink onto a recording medium;

a purging apparatus for purging the nozzle to improve the ejection of ink from the nozzle;

a judging device for judging whether a first predetermined time period has passed or not after the last purging by the purging apparatus, if a command for operating the head for recording is input in the recorder; and an authorizing device for authorizing the operation of the head for recording if the judging device judges that the first period has passed.

2. The ink jet recorder defined in claim 1, wherein, if the judging device judges that the first time period has not passed, the authorizing device makes the recording stand by until the first period passes.

3. The ink jet recorder defined in claim 1, and further comprising a purge controller for controlling the purging apparatus, the controller making the purging apparatus perform purging before the recording head performs the recording authorized by the authorizing device.

4. The ink jet recorder defined in claim 3, wherein, after the purge controller makes the purging apparatus perform purging, the authorizing device makes the recording head wait a predetermined time before starting the recording.

5. The ink jet recorder defined in claim 3, wherein the ejection nozzle includes a plurality of nozzles, the purging apparatus being able to purge each of the nozzles in accordance with an input command, whereby, when two or more of the nozzles are purged, the purge controller makes each of the two or more nozzles purged once in order and at least once again in order.

6. The ink jet recorder defined in claim 5, wherein the recorder waits a predetermined time after each of the two or more nozzles is purged once and before similar purging is performed at least once for the two or more nozzles.

7. The ink jet recorder defined in claim 6, wherein, after the recording waits the predetermined time, similar purging is repeated a plurality of times for the two or more nozzles.

8. The ink jet recorder defined in claim 1, wherein the first time period is one minute.

9. The ink jet recorder defined in claim 1, and further comprising:

a timer for clocking a second time period after the last purging;

the purge controller controlling the purging by the purging apparatus depending on the second period clocked by the timer, if a command for operating the recording head is input in the recorder;

the authorizing device authorizing the recording by the recording head when the first time period has passed after the purging controlled depending on the second period.

10. The ink jet recorder defined in claim 1, and further comprising a timer for clocking a second time period after the last purging, the recording head having a plurality of nozzles, the purge controller controlling the purging apparatus in such a manner that, if there is a command for the recording by the head, the purging controlled depending on the second period clocked by the timer is performed, whereby, when two or more of the nozzles are purged, the controller makes the two or more nozzles purged once in order and at least once again in order.

11. An ink jet recorder comprising:

a recording head having a plurality of ejection nozzles for ejecting ink onto a recording medium;

a purging apparatus which can purge the nozzles one after one to improve the ejection of ink from the nozzles;

a determining device for determining a time having passed after the last purging;

a purge controller for controlling the purging depending on the length of the time determined by the determining device, if there is a command for operating the head; and an authorizing device for authorizing the operation of the head, after or without purging, in accordance with the determination by the determining device;

whereby, when two or more of the nozzles are purged, the controller makes the two or more individual nozzles purged once sequentially and at least once again sequentially.

12. The ink jet recorder defined in claim 11, wherein the purge controller causes the two or more nozzles to be purged once in order, then to wait a predetermined time, and thereafter to be purged at least once again in order.

13. An ink jet recorder comprising:

a recording head having a plurality of ejection nozzles for ejecting ink onto a recording medium;

a purging apparatus which can purge the nozzles one after one to improve the ejection of ink from the nozzles; and a purge controller for controlling the purging by the purging apparatus in such a manner that, when two or more of the nozzles are purged, the two or more individual nozzles are purged once sequentially and at least once again sequentially.

14. The ink jet recorder defined in claim 13, wherein the purge controller causes the two or more nozzles to be purged once in order, then to wait a predetermined time, and thereafter to be purged at least once again in order.

15. The ink jet recorder defined in claim 14, wherein similar purging is repeated a plurality of times after the nozzles wait the predetermined time.

16. An ink jet recorder comprising:

a recording head having an ejection nozzle for ejecting ink onto a recording medium;

a purging apparatus for purging the nozzle; and a controller for controlling the purging apparatus in such a manner that the apparatus repeats first purging for the nozzle a first predetermined number of times, then halts until the predetermined time has passed which a air bubbles in the ink in the head take to vanish, and thereafter performs second purging for the nozzle a second predetermined number of times.

17. The ink jet recorder defined in claim 16, and further comprising an ink supply for supplying the recording head with ink;

the first predetermined number of times is the number of repetitions of the first purging which is necessary for introducing ink from the supply up to the front end of the ejection nozzle.

18. The ink jet recorder defined in claim 16, wherein the recording head has a plurality of nozzles;

the purge controller controlling the purging apparatus in such a manner that the apparatus repeats the first purging for each of the nozzles the first predetermined number of times, then halts until the predetermined time passes, and thereafter performs the second purging for each of the nozzles the second predetermined number of times.

19. An ink jet recorder comprising:

a recording head having an ejection nozzle for ejecting ink onto a recording medium to record on the medium;

an ink cartridge for supplying the head with ink;

a suction cap for contact with the nozzle surface of the nozzle;

a suction pump for sucking ink out of the cartridge from the ejection side of the nozzle through the cap; and a purge controller for controlling the purging of the nozzle by the cap and the pump;

whereby, after the cartridge is replaced with a new ink cartridge, the controller makes the nozzle purged a number of times which is necessary for introducing ink from the new cartridge up to the front end of the nozzle, then halts the purging until a time passes which the air bubbles in the introduced ink take to vanish, and thereafter makes the nozzle purged a predetermined number of times.

20. The ink jet recorder defined in claim 19, wherein the ejection nozzle includes a plurality of nozzles, the ink cartridge including cartridges each associated with one of the nozzles;

the purge controller making each of the nozzles purged the number of times which is necessary for introducing ink up to the front end of the nozzle, and thereafter making each of the nozzles purged the predetermined number of times when the time has passed which the air bubbles in the introduced ink take to vanish after the particular nozzle is purged for the first time.

21. An ink jet recorder, comprising:

a recording head having at least one ejection nozzle for ejecting ink onto a recording medium;

a purging apparatus for recovering the ejection of ink from the nozzle;

a timer for clocking the time having passed after the last purging by the purging apparatus or a waiting period; and a controller for controlling the head and the purging apparatus;

the controller starting the head ejecting ink if the time clocked by the timer exceeds the waiting period.

22. A recording method of an ink jet recorder including a recording head, which has an ejection nozzle, and a purging apparatus for purging the nozzle, the method comprising the steps of:

clocking the time which has passed after the last purging by the purging apparatus;

judging whether the clocked time exceeds a predetermined time period or not, before the recording by the head;

starting the recording by the head if it is judged that the clocked time exceeds the period; and waiting for the recording until the clocked time exceed the period if it is judged that the clocked time does not exceed the period.

23. The recording method defined in claim 22, and further comprising the step of purging the nozzle before the recording by the recording head if it is judged that the clocked time exceeds the predetermined time period.

24. A purging method of an ink jet recorder including a recording head, which has a plurality of nozzles for ejecting different color inks, and a purging apparatus for purging the nozzles one by one, the method comprising the steps of:

purging the individual nozzles once sequentially; and purging the purged individual nozzles at least once again sequentially.

* * * * *